US007027752B2

(12) United States Patent
Yon et al.

(10) Patent No.: US 7,027,752 B2
(45) Date of Patent: Apr. 11, 2006

(54) WET-TYPE ELECTROPHOTOGRAPHIC PRINTER WITH PHOTOCATALYSTIC FILTER

(75) Inventors: Kyung-yol Yon, Seongnam (KR); Jeong-hun Pang, Suwon (KR); Joong-hwan Choi, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/649,773

(22) Filed: Aug. 28, 2003

(65) Prior Publication Data

US 2004/0047646 A1 Mar. 11, 2004

(30) Foreign Application Priority Data

Sep. 10, 2002 (JP) ..... 2002-54544

(51) Int. Cl.
*G03G 21/20* (2006.01)

(52) U.S. Cl. ..... 399/93

(58) Field of Classification Search ..... 95/273, 95/274; 399/93, 98, 250, 251, 122
See application file for complete search history.

(56) References Cited

U.S. PATENT DOCUMENTS 6,535,703 B1 * 3/2003 Yamamoto et al. ..... 399/93

FOREIGN PATENT DOCUMENTS

JP 2002-276999 * 9/2002

* cited by examiner

*Primary Examiner*—Hoang Ngo
(74) *Attorney, Agent, or Firm*—Staas & Halsey LLP

(57) ABSTRACT

A wet-type electrophotographic printer having a photocatalystic filter includes a discharge passage through which air inside a printer body is discharged out, at least one discharge fan positioned inside the discharge passage to guide the air inside the printer body, and a photocatalystic filter positioned inside the discharge passage and having a photocatalystic body coated with a photocatalyst, a plasma electrode and a plasma generator to filter and deodorize the air inside the printer body. Accordingly, a bad smell and air pollution from evaporation of a liquid carrier can be solved, and an excellent printing quality is provided.

20 Claims, 4 Drawing Sheets

WET-TYPE ELECTROPHOTOGRAPHIC PRINTER WITH PHOTOCATALYSTIC FILTER

CROSS-REFERENCE TO RELATED APPLICATIONS

This application claims the benefit of Korean Patent Application No. 2002-54544, filed Sep. 10, 2002, in the Korean Intellectual Property Office, the disclosure of which is incorporated herein by reference.

BACKGROUND OF THE INVENTION

1. Field of the Invention

The present invention relates to a wet-type electrophotographic printer, and more particularly, to a wet-type electrophotographic printer provided with a photocatalystic filter that uses a plasma for completely decomposing a carrier vapor of a high concentration through oxidation, thus being capable of filtering and deodorizing dirt-containing air.

2. Description of the Related Art

Generally, an electrophotographic printer is categorized according to a developing method into a dry type that uses powder toner, and a wet-type that uses a composition of a carrier liquid, such as norpar or toner. Both the dry type and the wet type are used in a printing process of forming an electrostatic latent image on a photoreceptor medium, such as a photoreceptor drum (body), feeding the toner onto the electrostatic latent image to develop the electrostatic latent image into a visible image, and printing the developed visible image onto a sheet of printing paper by passing the paper between a transfer medium that is rotated while being in contact with the photoreceptor body.

While the dry type electrophotographic printer has some disadvantages, such as harmful toner powders, the wet-type electrophotographic printer generates no harmful toner powders and provides an excellent printing quality. Accordingly, the wet-type electrophotographic printer is in demand.

FIG. 1 is a schematic view showing a structure of a conventional wet-type electrophotographic printer 80. As shown, the wet-type electrophotographic printer 80 includes organic photoreceptors 50*a*–50*d*, developing rollers 51*a*–51*d*, an intermediate transfer belt 70, a fusing roller 40, and laser scanning units 60*a*–60*d*.

A carrier liquid of the wet-type electrophotographic printer 80 consists of a pigment, a binder resin and a charge detector dispersed therein. For developing an image on a printing medium, such as a sheet of paper, in the wet-type electrophotographic printer 80, firstly, an electrostatic latent image is formed on the organic photoreceptors 50*a*–50*d* by laser beams emitted from the laser scanning units 60*a*–60*d*. Then, a carrier liquid is attached to the electrostatic latent image of the organic photoreceptors 50*a*–50*d* by the developing rollers 51*a*–51*d*. After that, the developed image is transferred to the printing medium. When the printing medium with the image thereon passes through the heated fusing roller 40, the carrier liquid evaporates into vapor. Since there is a hydrocarbon mixture in the carrier liquid, the vapor may include one of volatile organic compounds (VOCs), such as benzene, acetylene, gasoline, toluene, ethylene, phenol, methanol, butanol, acetone, methylethyl ketone, or acetic acid. Through a photochemical reaction with nitrogen oxide, the VOCs generate photochemical oxide, causing photochemical smog. The VOCs are poisonous chemical substances that pollute air, incite (induce) cancer, and are a precursor of the photochemical oxide.

Because of a bad smell of a carrier vapor and an environmental pollution, usage of the wet-type electrophotographic printer 80 has been checked despite advantages over the dry-type electrophotographic printer.

Particularly, air purifying machines that use a conventional photocatalyst require a UV lamp for photocatalystic activity and subsequent decomposition of an organic substance. However, the photocatalystic activity by the UV lamp, due to a considerably slow response and activation, was not enough to decompose the organic substance, such as the one in the wet-type electrophotographic printer, which accumulates to a high concentration from the beginning of printing.

SUMMARY OF THE INVENTION

Accordingly, it is an aspect of the present invention to provide a wet-type electrophotographic printer having a photocatalystic filter using a plasma, which is capable of decomposing a volatile organic substance contained in a high concentration into a vapor generated from evaporation of a liquid carrier and subsequently resolving environmental problems and achieving effective deodorization.

Additional aspects and advantages of the invention will be set forth in part in the description which follows and, in part, will be obvious from the description, or may be learned by practice of the invention.

The above and/or other aspects of the present invention are accomplished by providing a wet-type electrophotographic printer having a photocatalystic filter. The wet-type electrophotographic printer includes a discharge passage through which air inside a printer body is discharged out, at least one discharge fan positioned inside the discharge passage to guide the air inside the printer body to an outside of the printer body, and the photocatalystic filter positioned inside the discharge passage and having a photocatalystic body coated with a photocatalyst, a plasma electrode disposed on the photocatalystic body, and a plasma generator coupled to the plasma electrode to filter and deodorize the air inside the printer body.

The photocatalyst includes at least one selected from a group consisting of $TiO_2$ (titanium dioxide), $SiO_2$ and ZnO (zinc oxide). The photocatalyst is $TiO_2$ (titanium dioxide).

The photocatalystic body is a honey-comb matrix coated with either a ceramic or a metal.

The photocatalystic body includes at least one of $\gamma$-$Al_2O_3$, $ZrO_2$, $SiO_2$, and $SiO_2$—$Al_2O_3$.

The photocatalystic filter is provided with respective poles of the plasma electrode on front and rear sides of the photocatalystic body, and the plasma generator is connected to the poles of the plasma electrode.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
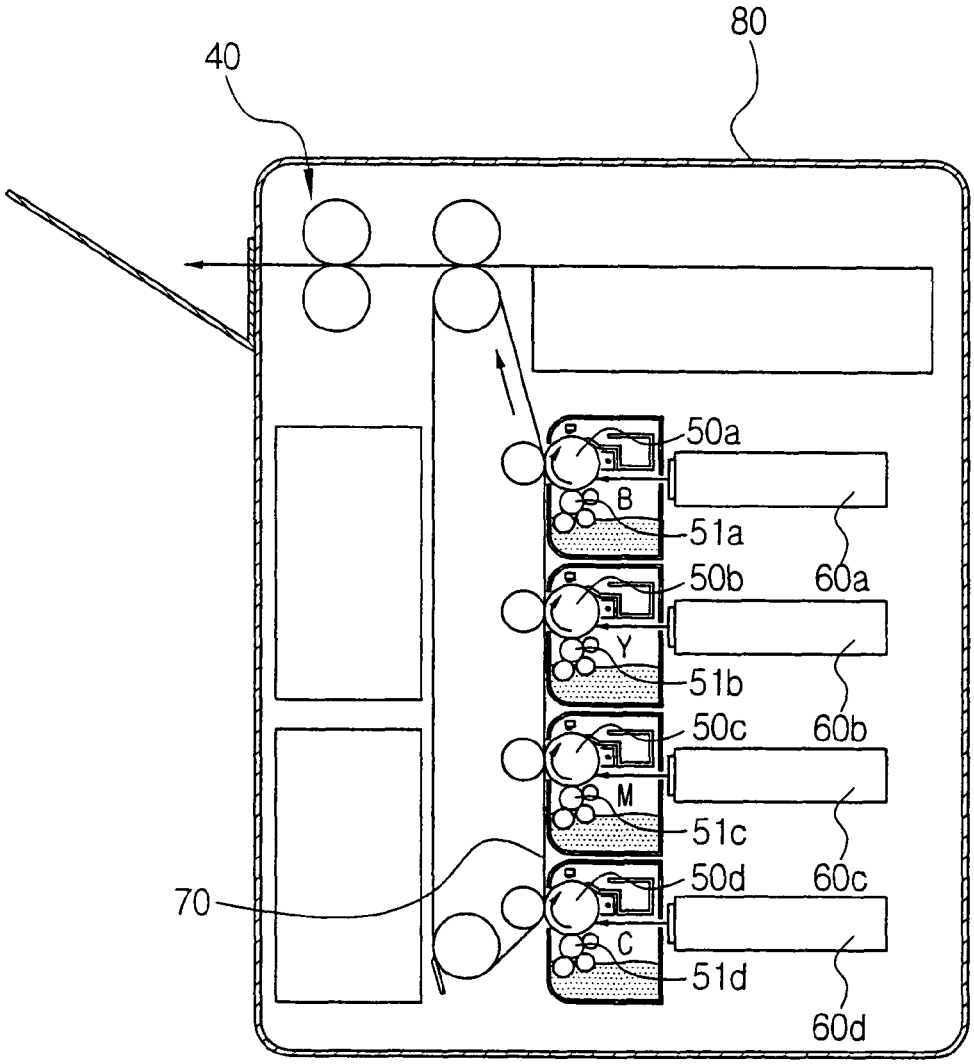
FIG. 1 (PRIOR ART)
FIG. 1 is a schematic view showing a structure of a conventional wet-type electrohpotographic printer.

Reference will now be made in detail to the present preferred embodiment of the present invention, examples of which are illustrated in the accompanying drawings, wherein like reference numerals refer to the like elements throughout. The embodiment is described in order to explain the present invention by referring to the figures.

Hereinafter, the present invention will be described in detail with reference to the accompanying drawings with an example of a wet-type electrohpotographic printer having a photocatalystic filter.

Figure 2:
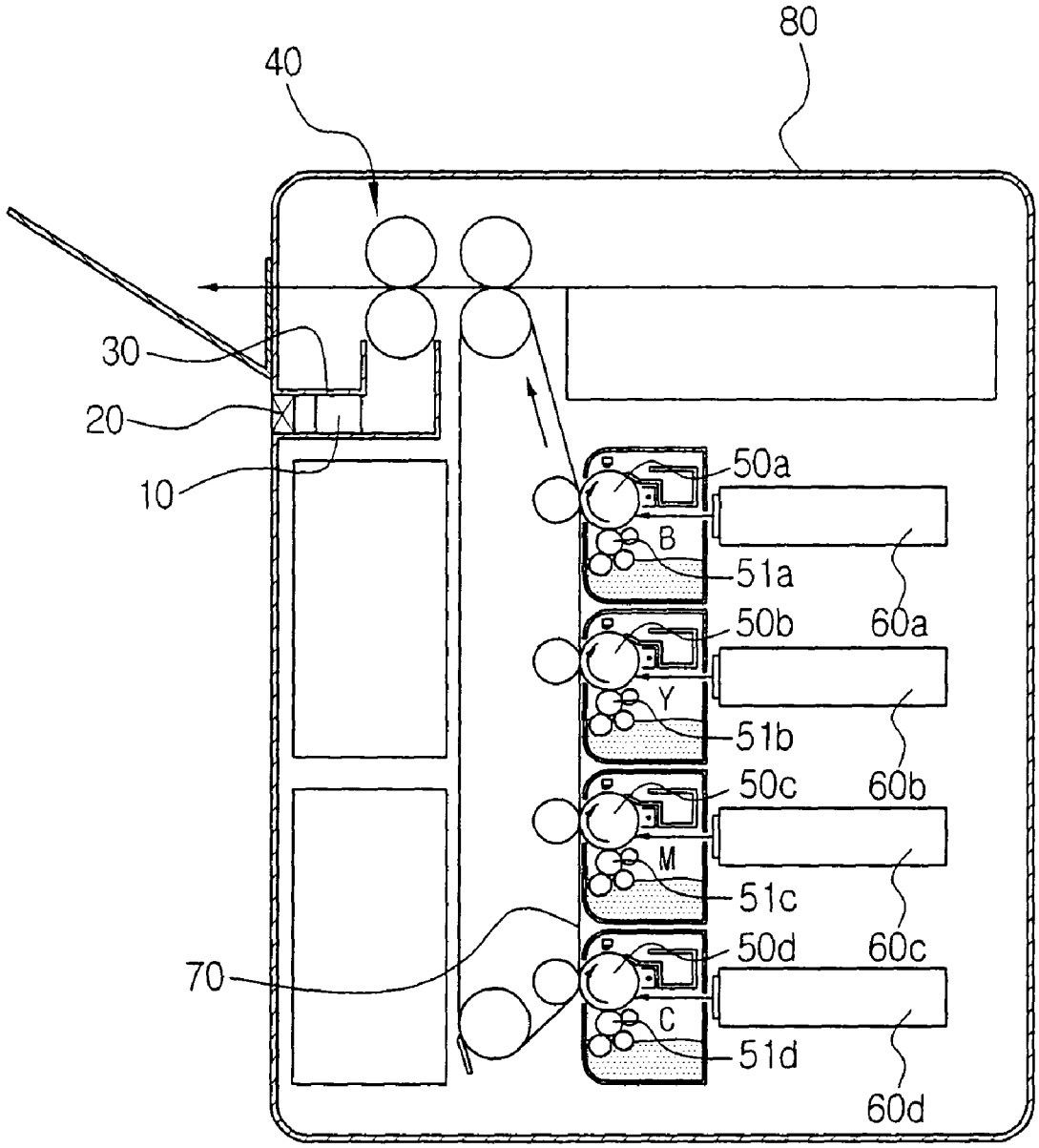
FIG. 2 is a schematic view showing a wet-type electrophotographic printer having a photocatalystic filter according to an embodiment of the present invention.

Referring to FIG. 2, the wet-type electrohpotographic printer according to an embodiment of the present invention includes organic photoreceptors 50*a*–50*d*, developing rollers 51*a*–51*d*, an intermediate transfer belt 70, a fusing roller 40, and laser scanning units 60*a*–60*d*, like a conventional wet-type electrophotograhpic printer, and further includes a discharge passage (duct) 30 provided near the fusing roller 40 to guide air inside a printer body 80 toward a predetermined direction, a photocatalystic filter 10 disposed inside the discharge passage 30, and a fan 20.

Since the organic photoreceptors 50*a*–50*d*, the developing rollers 51*a*–51*d*, the intermediate transfer belt 70, the laser scanning units 60*a*–60, and fusing roller 40 are generally known, detailed descriptions are omitted.

An air inlet of the discharge passage 30 is provided in the proximity to the fusing roller 40 and guides the air inside the printer body 80 in a predetermined direction from the fusing roller 40 to an outside of the printer body 80. The predetermined direction of externally discharging the inside air through the discharge passage 30 may vary depending on components of the printer body 80, and it may be an upper, lower, left, or left side of the fusing roller 40.

Figure 3A:
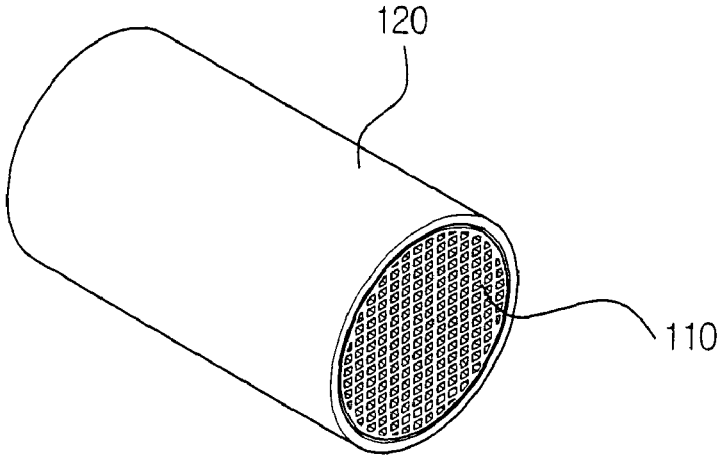
FIG. 3A is a view illustrating the plasma electrode and the photocatalystic body of the photocatalystic filter.
Figure 3B:
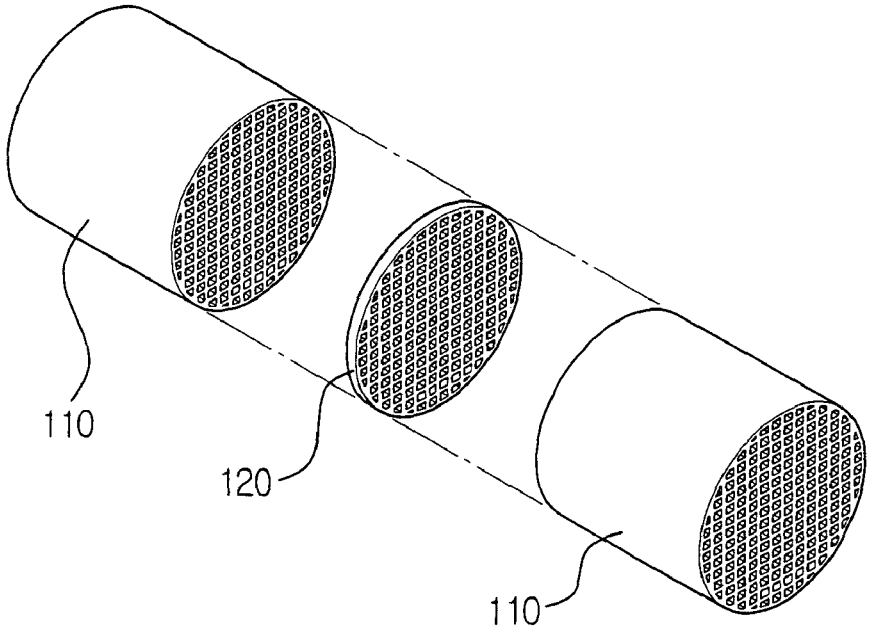
FIG. 3B is another view illustrating the plasma electrode and the photocatalystic body of the photocatalystic.
Figure 4:
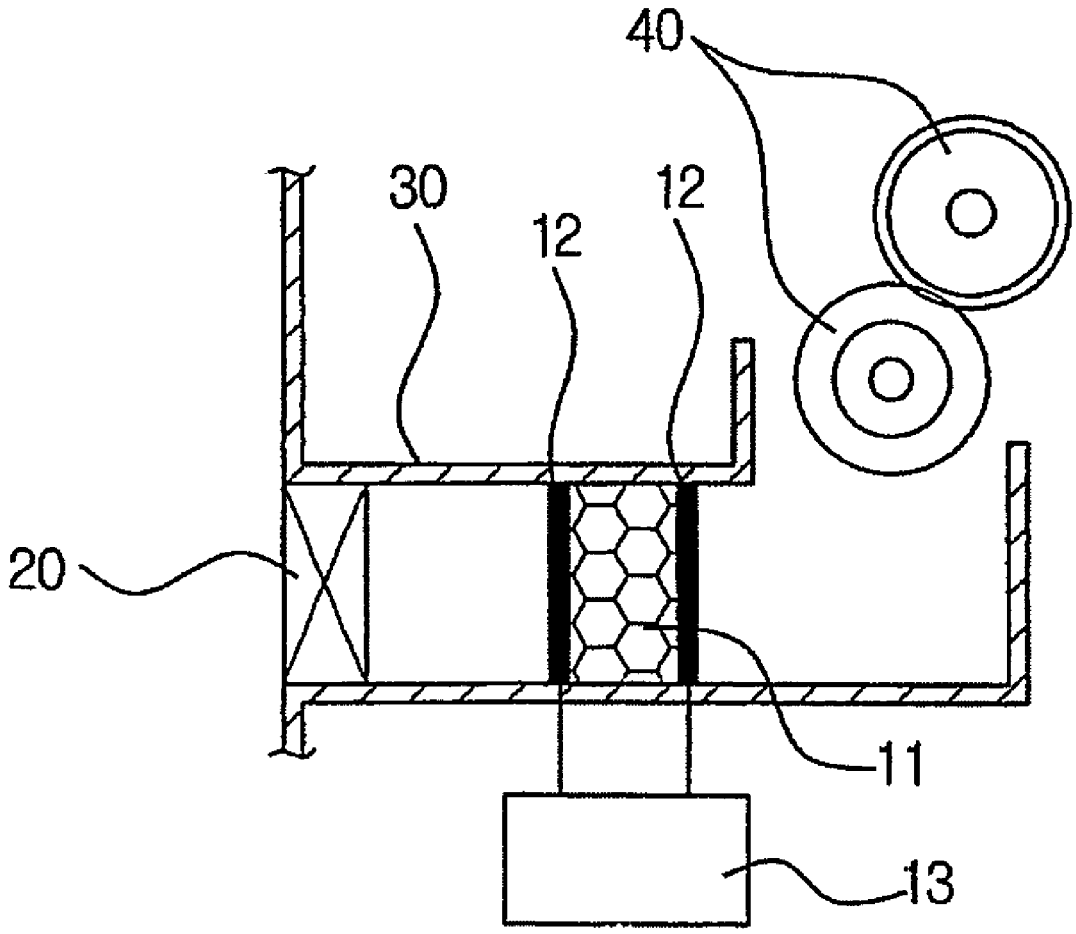
FIG. 4 is a schematic view illustrating the photocatalystic filter of the wet-type electrophotographic printer of FIG. 2.

Referring to FIG. 3(A, B) and FIG. 4 , the photocatalystic filter 10 includes a plasma electrode 12, a plasma generator 13 and a photocatalystic body 11 coated with the photocatalyst agent. with FIG. 3(A, B) illustrating the photocatalystic filter 10 as photocatalysitc filter 110 and plasma electrode 12 as plasma electrode 120. The plasma electrode 12 includes poles disposed at both opposite sides, i.e., in front and rear sides, of the photocatalystic body 11 in an air discharging direction. Due to a considerably wide voltage gap between the both poles of the plasma electrode 12 at the front and rear sides of the photocatalystic body 11, plasma is generated, and the generated plasma causes a chemical reaction in the air passing through the photocatalystic body 11.

The plasma generator 13 is connected to the both poles of the plasma electrode 12.

The photocatalyst coated on the photocatalystic body 11 includes at least one selected from the group including $TiO_2$ (titanium dioxide), $SiO_2$ and ZnO (zinc oxide). It is possible that the $TiO_2$ is used for the photocatalyst.

With the $TiO_2$ as the photocatalyst, the chemical reaction in filtering and deodorizing carrier vapor contained in the air can be expressed by the following reaction formula 1.

Reaction formula 1

$$TiO_2 \xrightarrow{hv} TiO_2\,(h^+) + e^-$$

First, as the plasma generated from the plasma electrode 12 is irradiated to the photocatalystic body 11 coated with the $TiO_2$, stimulated electrons ($e^-$) and holes ($h^+$) are formed by the chemical reaction of the $TiO_2$ as in the formula 1.

$$e^- + O_2 \rightarrow \cdot O_2^- \cdot O_2^- + H^+ \leftrightarrows \cdot HO_2^- \qquad \text{Reaction formula 2}$$

The reaction formula 2 represents the chemical reaction in which free (stimulated) electrons ($e^-$) that are generated from the chemical reaction in the reaction formula 1 form hydrogen peroxide with ambient oxygen through the chemical reaction.

$$h^+ + H_2O \rightarrow \cdot OH + H^+ \qquad \text{Reaction formula 3}$$

The reaction formula 3 represents the chemical reaction in which the stimulated holes ($h^+$) generated by the chemical reaction in the reaction formula 1 form a hydroxyl group with water through the chemical reaction.

The hydrogen peroxide or the hydroxyl group formed by the free electrons ($e^-$) and the stimulated holes ($h^+$), respectively, contacts a hydrocarbon compound of the carrier vapor passing through the photocatalystic filter 10 to decompose the hydrocarbon compound into carbon dioxide and water, thereby removing a toxic property and a smell of the hydrocarbon compound from the air.

As for a source of energy supplied to the photocatalyst, such as $TiO_2$ (titanium dioxide), ultraviolet light can be used. Accordingly, it is possible to provide the photocatalystic filter 10 with an ultraviolet lamp in place of the plasma electrode 12 and plasma generator 13. However, it is possible, but not limited, to use the plasma to obtain more active photocatalystic reaction of the titanium dioxide because a wavelength of the plasma is shorter than that of the ultraviolet light approximately by 290 nm–340 nm to 180 nm–430 nm, while an intensity of the plasma having the wavelength is stronger than that of the ultraviolet light by a maximum, 120,000 a.u.t., to a minimum, 15,000 a.u.t. Also an optimum wavelength for an activation of the titanium dioxide as the photocatalyst hovers around 340 nm. Furthermore, since the photocatalystic reaction by the plasma has a higher responsivity and a shorter activation time, the photocatalystic filter 10 having the plasma electrode 12 and the plasma generator 13 is effective in filtering and deodorizing the carrier vapor of high concentration fast and in great amount.

The generally-known products can be used for the plasma electrode 12 and the plasma generator 13. In this embodiment, a non-thermal plasma system is employed for the plasma electrode 12 and the plasma generator 13. The plasma electrode 12 and the plasma generator 13 in the non-thermal plasma system require a considerably high pressure to generate the plasma generation.

Since there is a high pressure around the plasma electrode 12 and the plasma generator 13, oxygen in the internal air of the printer body 80 generates ozone by the influence of the high pressure around the plasma electrode 12 and the plasma generator 13. The ozone is a component having a strong oxidation property and generates ozonide when being added with unsaturated hydrocarbon. More specifically, the ozonide is a compound formed by adding the ozone to a double or triple bond of an unsaturated organic compound. With the addition of water, the double or triple bond between carbons is severed, and the ozonide becomes a carbonyl group, generating ketone and aldehyde. In other words, the ozone generated around the plasma electrode 12 and the plasma generator 13 is involved in decomposing the hydrocarbon compound, which is the carrier vapor. Since the wet-type electrophotographic printer having the photocatalystic filter 10 according to the present invention is capable of decomposing the volatile organic compound using the photocatalystic reaction and also using the ozone generated around the plasma electrode 12 and the plasma generator 13, the decomposition of the volatile organic compound becomes more effective.

Any one of the ceramic and the metal may be used as the photocatalystic body 11, or one selected from a group having $\gamma$-$Al_2O_3$, $ZrO_2$, $SiO_2$, and $SiO_2$—$Al_2O_3$ may be used as the photocatalystic body 11. The photocatalystic body 11 may be formed as a honey-comb matrix of a lattice pattern. A wider surface area can be ensured as the honey-comb matrix is more densely perforated, and more carrier vapor can be absorbed and thus decomposed by the photocatalystic reaction. Accordingly, it is possible to use a more densely perforated honeycomb matrix as the photocatalystic body 11. Furthermore, it is possible that the photocatalystic body 11 has the same outer radius as an inner radius of the discharge passage 30. The photocatalystic body 11 may be formed such that it can have a circular or square section. In other words, the photocatalystic body 11 may be formed as a cylinder or rectangular solid with no specific limit for a height thereof.

In addition to the plasma electrode 12, the plasma generator 13 and the photocatalystic body 11 coated with the photocatalyst, a carbon filter having an absorbent material may also be provided to the photocatalystic filter 10.

In order to induce an air stream in the predetermined direction, the fan 20 is provided inside of the discharge passage 30. The fan 20 may be disposed between the inlet portion of the discharge passage 30 and the photocatalystic filter 10, or between the photocatalystic filter 10 and an outlet portion of the discharge passage 30. More than 2 fans 20 may be provided.

In the wet-type electrophotographic printer, while the printing medium passes through the fusing roller 40 having a high temperature, the liquid carrier evaporates to generate harmful vapors of the hydrocarbon compound having the foul smell and the toxic property. However, with the photocatalystic filter 10 according to the present invention, the hydrocarbon compound of the vapor entering the discharge passage 30 is decomposed into the water and the carbon dioxide by the photocatalystic reaction as the vapor passes through the photocatalystic filter 10, and discharged out through the outlet portion of the discharge passage 30. As a result, the wet-type electrophotographic printer exhausts non-toxic and odorless air.

As described above, in the wet-type electrophotographic printer having the photocatalystic filter 10 according to the present invention, a harmful volatile organic compound generated in the printer body during the evaporation of the liquid carrier is decomposed into the carbon dioxide and the water when the vapor of the liquid carrier passes through the photocatalystic filter 10. As a result, an environment-friendly and odorless wet-type electrophotographic printer with a high printing quality can be provided.

Although a few embodiments of the present invention has been described, it will be understood by those skilled in the art that the present invention should not be limited to the described preferred embodiments, but various changes and modifications can be made within the spirit and scope of the present invention as defined by the appended claims and their equivalents.

What is claimed is:

1. A wet-type electrophotographic printer having a printer body, comprising:

a discharge passage through which air inside the printer body is discharged out to an outside of the printer body;

at least one discharge fan positioned inside the discharge passage to guide the air inside the printer body to the outside of the printer body; and a photocatalystic filter positioned inside the discharge passage, and having a photocatalystic body coated with a photocatalyst, a plasma electrode disposed on the photocatalystic body, and a plasma generator coupled to the plasma electrode to filter and deodorize the air inside the printer body.

2. The wet-type electrostatic printer of claim 1, wherein the photocatalyst comprises:

at least one selected from a group having $TiO_2$ (titanium dioxide), $SiO_2$ and ZnO (zinc oxide).

3. The wet-type electrophotographic printer of claim 1, wherein the photocatalyst comprises:

$TiO_2$ (titanium dioxide).

4. The wet-type electrophotographic printer of claim 1, wherein the photocatalystic body comprises:

a honey-comb matrix made of one of a ceramic and a metal.

5. The wet-type electrophotographic printer of claim 1, wherein the photocatalystic body comprises:

at least one selected from a group having $\gamma$-$Al_2O_3$, $ZrO_2$, $SiO_2$, and $SiO_2$—$Al_2O_3$.

6. The wet-type electrophotographic printer of claim 1, wherein the photocatalystic body coated with the photocatalyst, and the photocatalystic filter comprises a plurality of poles of the plasma electrode formed on front and rear sides sides of the photocatalystic body, and the plasma generator is connected to the poles of the plasma electrode.

7. A wet-type electrophotographic printer having a printer body and a fusing roller unit fusing a developed image on a sheet of paper, comprising:

a discharge duct having an inlet portion disposed adjacent to the fusing roller and an outlet portion disposed between the inlet portion and an outside of the printer body to discharge air from an inside of the printer body to the outside of the printer body;

a discharge fan disposed in the discharge duct and between the inlet portion and the outlet portion to guide the air inside the printer body in a direction from an inside of the printer body to the outside of the printer body along the discharge duct; and a photocatalystic filter disposed in the discharge duct between the inlet portion and the outlet portionto filter and deodorize the air passing through the discharge duct.

8. The wet-type electrophotographic printer of claim 7, wherein the inlet portion of the discharge duct is disposed to enclose a portion of the fusing roller unit.

9. The wet-type electrophotographic printer of claim 7, wherein the fusing roller unit comprises a fusing roller and a backup roller, the paper passes through between the fusing roller and the backup roller, and a portion of one of the fusing roller and the backup roller is disposed in an inside of the inlet portion of the discharge duct.

10. The wet-type electrophotographic printer of claim 9, wherein the common center line meets a line in the direction of the air in the discharge duct.

11. The wet-type electrophotographic printer of claim 7, wherein the photocatalystic filter has the same area as the discharge duct in a direction from the inlet portion to the outlet portion.

12. The wet-type electrophotographic printer of claim 7, wherein the photocatalystic filter comprises:

a carbon filter having an absorbent material.

13. The wet-type electrophotographic printer of claim 7, wherein the photocatalystic filter comprises:

a non-thermal plasma system.

14. The wet-type electrophotographic printer of claim 7, wherein the photocatalystic filter comprises:

a photocatalystic body coated with a photocatalyst;

a plasma electrode disposed on the photocatalystic body; and a plasma generator coupled to the plasma electrode to filter and deodorize the air inside the printer body.

15. The wet-type electrophotographic printer of claim 14, wherein the photocatalystic body of the photocatalystic filter is perforated.

16. The wet-type electrophotographic printer of claim 14, wherein the photocatalystic body of the photocatalystic filter comprises a first side facing the inlet portion and a second side facing the outlet portion, and the plasma electrode comprises:

a first pole coupled to the first side of the photocatalystic body; and a second pole coupled to the second side of the photocatalystic body.

17. The wet-type electrophotographic printer of claim 7, wherein the photocatalystic filter comprises:

a photocatalystic body coated with a photocatalyst to generate plasma to obtain an active photocatalysic reaction from the photocatalyst.

18. The wet-type electrophotographic printer of claim 17, wherein the photocatalyst comprises:

one of $TiO_2$ (titanium dioxide), $SiO_2$ and ZnO (zinc oxide).

19. The wet-type electrophotographic printer of claim 17, wherein the photocatalyst body comprises:

one of ceramic and a metal.

20. The wet-type electrophotographic printer of claim 17, wherein the photocatalyst body comprises:

one of a honey-comb matrix shape, a circle, and a rectangle in cross-section in another direction perpendicular to the direction of the air.

* * * * *

UNITED STATES PATENT AND TRADEMARK OFFICE

CERTIFICATE OF CORRECTION

PATENT NO. : 7,027,752 B2
APPLICATION NO. : 10/649773
DATED : April 11, 2006
INVENTOR(S) : Kyung-yol Yon et al.

It is certified that error appears in the above-identified patent and that said Letters Patent is hereby corrected as shown below:

Column 6, line 37, delete “sides” (second occurrence)

Column 6, line 53, change “portionto” to --portion to--

Column 8, line 8, change “photocatalysic” to --photocatalystic--

Signed and Sealed this

Nineteenth Day of September, 2006

JON W. DUDAS
*Director of the United States Patent and Trademark Office*